United States Patent [19]

Gebelin

[11] 4,212,583

[45] Jul. 15, 1980

[54] APPARATUS FOR USE IN POSITIONING A UNIT ON A TUBE-PLATE

[75] Inventor: Bernard Gebelin, Courbevoie, France

[73] Assignee: Framatome, Courbevoie, France

[21] Appl. No.: 915,208

[22] Filed: Jun. 13, 1978

[30] Foreign Application Priority Data

Jun. 15, 1977 [FR] France ..... 77 18392

[51] Int. Cl.[2] ..... B25J 3/00

[52] U.S. Cl. ..... 414/728; 414/590; 414/631; 414/750; 414/909; 165/76

[58] Field of Search ..... 414/10, 146, 728, 182, 414/222, 225, 569, 589, 590, 598, 630, 631, 662, 668, 671, 672, 680, 743, 909, 749, 750; 165/76

[56] References Cited

U.S. PATENT DOCUMENTS

| | | | |
|---|---|---|---|
| 3,409,158 | 11/1968 | Lull | 414/590 X |
| 3,913,752 | 10/1975 | Ward et al. | 165/76 X |
| 3,934,731 | 1/1976 | Müller et al. | 414/749 |
| 4,004,698 | 1/1977 | Gebeun | 165/76 X |
| 4,074,814 | 2/1978 | Cooper et al. | 414/751 |
| 4,148,403 | 4/1979 | Riffe | 165/76 X |

*Primary Examiner*—Frank E. Werner

*Attorney, Agent, or Firm*—Haseltine, Lake & Waters

[57] ABSTRACT

Apparatus for use in positioning a unit successively relative to a plurality of tubes of a regular array of tubes supported by a tube-plate within an enclosure provided with an access opening, e.g. relative to the boiler tubes of a steam generator of a nuclear power station, as described in U.S. Pat. No. 4,004,698 is adapted for association with transporting apparatus for placing the positioning apparatus in the enclosure, the transporting apparatus comprising a rectilinear guide rod for passing through the access opening and for guiding a carriage provided with a coupling assembly for releasably coupling the positioning apparatus to the carriage during movement thereof between the outside and the inside of the enclosure and which are disconnectable to permit movement of the positioning apparatus across the tube-plate.

7 Claims, 8 Drawing Figures

APPARATUS FOR USE IN POSITIONING A UNIT ON A TUBE-PLATE

BACKGROUND OF INVENTION

The invention relates to apparatus for use in positioning a unit opposite a tube of a regular array of tubes which open out onto a tube-plate and are housed in an enclosure provided with an access opening. It is particularly but not exclusively applicable to the positioning of a unit which is intended to be placed successively opposite all the tubes in a nest of boiler tubes of a steam generator of a nuclear power station, the unit being for example a guide-tube for a checking probe, a machining head or a welding head.

The very large number of tubes in the nest of boiler tubes of a steam generator of a pressurized water nuclear power station must be periodically checked in order to detect possible corrosion. This checking is usually carried out by means of an eddy current probe which is inserted successively into each of the tubes and is connected to apparatus for processing the signal from the probe. The probe is arranged inside a flexible guide-tube and brought successively opposite each of the boiler tubes which are to be checked. When the mouth of the guide-tube is correctly centered opposite one of the boiler tubes, the probe is propelled into the tube, for example by means of compressed air, and then withdrawn ready for insertion into another tube.

Attempts are obviously being made to reduce to a minimum the time required for checking all the tubes in the nest, in order to shorten the standstill time of the generator. Furthermore, the area of the boiler tubes is highly radioactive and it is absolutely obligatory to reduce human intervention to a minimum.

Hitherto, devices have been used in which the open end of the flexible guide-tube is carried by a carriage, which can be moved in two perpendicular directions, along guides which must be introduced through the manholes into the end water box of the nest and must be fixed to the plate. However, the steam generator, which must be pressure-resistant, is of cylindrical shape and the tube-plate is circular, with the result that, with these two perpendicular movements, the carriage cannot sweep the entire surface in order to enable the probe to reach all the tubes. The orientation of the fixed guides must consequently be altered several times.

This therefore makes it necessary for the operator to enter the water box, that is to say the zones of dangerous radioactivity, several times. The same also applies to the case where the tubes in the nest are U-shaped and the water chamber is divided into two compartments, with the result that the carriage can only sweep the surface of a semicircle.

Apparatus which limits human intervention is disclosed in U.K. Pat. No. 1,511,877 and U.S. Pat. No. 4,004,698 and comprises two arms which are each equipped with expansible mandrels capable of fixing themselves inside a tube. In use, each arm extends parallel to the plate and can move in the direction of its longitudinal axis relative to the other arm. The two arms can also be moved relative to one another, perpendicular to the plate. Thus, when the mandrels of one arm are fixed inside two tubes of the plate, the other arm can be moved along its axis and then towards the plate so as to engage its mandrels inside two tubes. The arm which was initially in position can then be disconnected from the tubes, moved away from the plate and fixed to two other tubes. This apparatus must initially be placed on the tube-plate by an operator who must therefore enter the steam generator.

SUMMARY OF INVENTION

The present invention relates to transporting apparatus which is used for bringing the positioning apparatus according to the abovementioned patent up to the tube-plate, and for withdrawing the apparatus. The advancing and withdrawing operations of the positioning apparatus can then be carried out using the transporting apparatus, without human intervention inside the enclosure housing the tubes.

According to the invention there is provided apparatus for use in positioning a unit successively relative to a plurality of tubes of a regular array of tubes supported by a tube-plate within an envelope provided with an access opening, the apparatus comprising positioning apparatus for supporting the unit and comprising two arms each provided with connecting means for insertion in the tubes of the plate and for connection thereto, the arms being movable relative to one another along three perpendicular directions, one of which is perpendicular to the plane of the plate and two are parallel to the plane of the plate, the amplitudes of the movements parallel to the plane of the plate being integral multiples of the spacing between the tubes and transporting apparatus associated with said positioning apparatus and comprising a rectilinear guide rod for passing through the access opening and for guiding a carriage provided with coupling means for releasably coupling said positioning apparatus to said carriage during movement thereof between the outside and the inside of the enclosure and which are disconnectable to permit movement of said positioning apparatus across the tube-plate.

Preferably the transporting apparatus includes a fixable support and means for articulating said rod on said support.

The invention will be more fully understood from the following description of an embodiment thereof, given by way of example only, with reference to the accompanying drawings.

IN THE DRAWINGS

DESCRIPTION OF INVENTION

Figure 1:
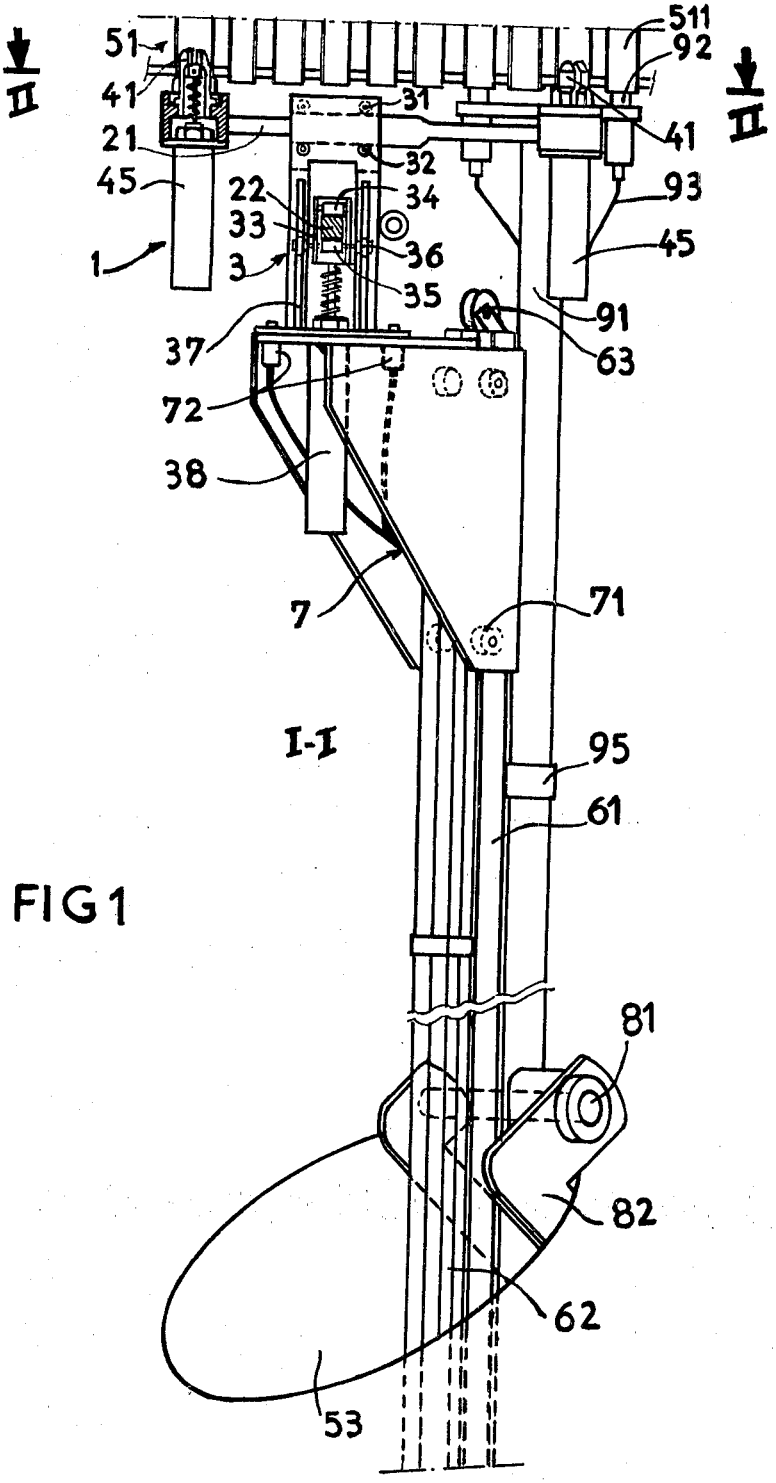
FIG. 1 is a total view showing an embodiment of positioning apparatus and the associated transporting apparatus according to the invention.
Figure 2:
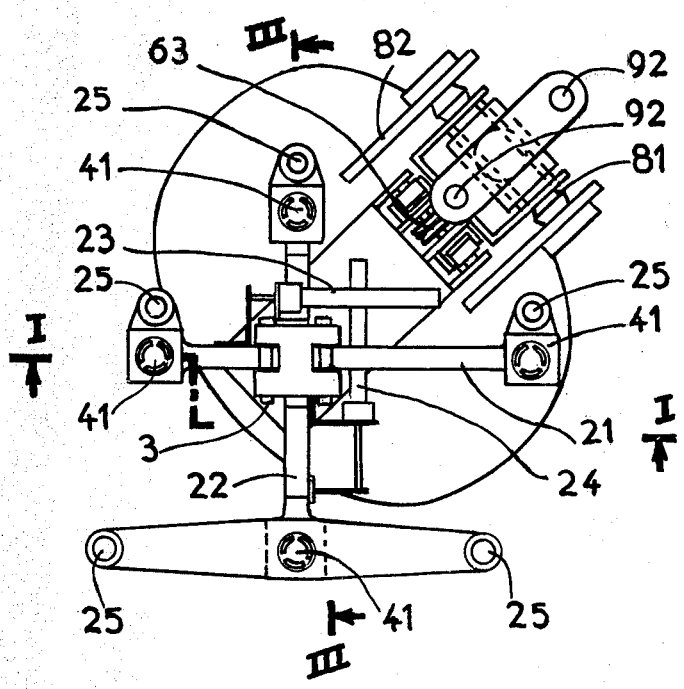
FIG. 2 is a view on the line II—II of FIG. 1.
Figure 3:
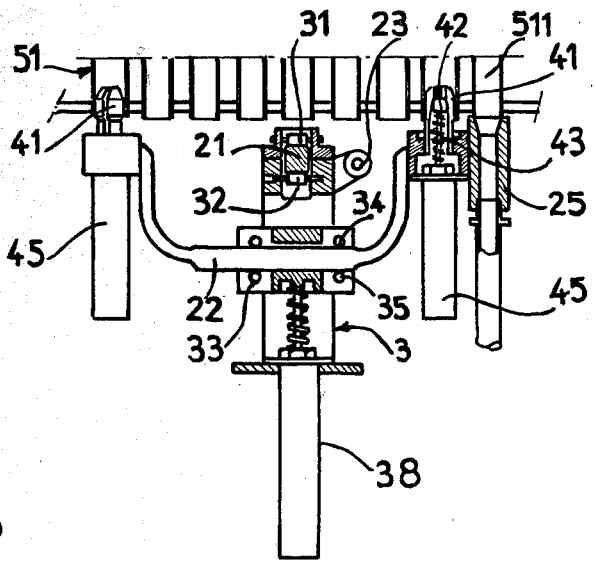
FIG. 3 is a view on the line III—III of FIG. 2.

Referring to FIGS. 1, 2 and 3, the positioning apparatus 1 comprises two arms 21, 22 which are each inserted in a guide and connector member 3. The arm 21, which has an overall rectilinear shape, is guided for movement in the direction of its longitudinal axis through a port in the clamp, at the end near tube-plate 51. In its translational motion through the port, the arm 21 is guided by two rollers 31 and two rollers 32.

The arm 22 is generally U-shaped, the rectilinear central part of which is guided in the direction of its longitudinal axis through a slide-block 33. The two arms 21 and 22 are slidable in perpendicular directions relative to one another. The arm 22 is guided in the slide-block 33 by means of two rollers 34 and two rollers 35. The slide-block 33 is itself guided from movement in the clamp 3 in a direction perpendicular to the arms 21 and 22 and to the plate 51 by means of rollers 36 which are engaged in conjugate grooves 37 in the clamp.

The movement of the arm 21 relative to the clamp 3 is controlled by a jack 23 which is mounted between a support firmly fixed to the clamp and a support firmly fixed to the arm. Similarly, the movement of the arm 22 relative to the slide-block 33 is controlled by a jack 24 which is mounted between a support firmly fixed to the carriage and a support firmly fixed to the arm.

Finally, the movement of the slide-block 33 through the clamp is controlled by a jack 38, the body of which is fixed to the clamp and the rod of which is fixed to the slide-block.

At each of their ends, the two arms 21 and 22 carry an expansible mandrel 41 which consists of a portion of a tube split into several lobes which has an external diameter which is slightly smaller than the internal diameter of the tubes 511 in the nest.

The tube portions of the mandrel are subjected to the action of an internal core 42 which, under the action of a spring 43, tends to separate the portions and thus increase the diameter of the mandrel. The core 42 is fixed to the rod of a single-acting jack 45 which, by compressing the spring 43, is capable of cancelling the force expanding the mandrel 41.

The stroke of the arms 21 and 22, through the clamp 3 and through the slide-block 33 respectively, is restricted to a distance equal to the spacing of the tubes 511 on the plate 51 by means of end-of-stroke contacts. Finally, the position of the slide-block 33 on the clamp 3 is controlled by an end-of-stroke contact. This contact is only actuated when the slide-block 33 is halfway along the clamp 3, as shown in the drawings, the four mandrels 41 then being in the same plane.

The apparatus supports at least one unit to be positioned opposite a tube, namely the end of a guide-tube. In the embodiment shown, the apparatus supports several guide-tubes 25. It could alternatively support one or more machining heads or welding heads. On the same arm, all the distances between the axes of mandrels, between the axes of guide-tubes or between the axis of a mandrel and the axis of a guide-tube, are integral multiples of the spacing of the boiler tubes in the nest.

The apparatus for transporting the positioning apparatus comprises a rectilinear rod or beam 61 which passes through the manhole 53 provided in the envelope 54 of the steam generator.

This rod 61 acts as a slide-bar for guiding a supporting carriage 7. The carriage is guided by means of rollers 71 which roll in grooves in the rod. Translational movement of the carriage is obtained by a drive mechanism cmprising an endless chain 62 to which the carriage is fixed and which passes round pulleys 63 and 64, one of which is a drive pulley.

The positioning apparatus is coupled to the carriage 7 during transport from the outside of the generator to the tube-plate 51 and it is uncoupled from this carriage during its movement across the tube-plate. The detachable coupling between the carriage and the positioning apparatus 1 is produced by means of fingers 72 which are mounted on the carriage 7. These fingers are expansible and are remotely controlled by means of cables. They can fix the apparatus 1 firmly to the carriage, and the apparatus 1 then rests on the carriage 7. When the apparatus 1 is connected to the boiler tubes in the tube-plate, after the apparatus 1 has been transported into the boiler, the removal of the coupling fingers from engagement with the apparatus 1 and the withdrawal of the slope-carriage suffice to fully disengage the apparatus 1 from the carriage 7.

The guide rod 61 is articulated on a fixed support 82 about a shaft 81, the support 82 being fixed to the flange 55 (FIGS. 6–8) of the manhole. The pivoting axis of the rod 61 is located near the bore of the manhole, on the inside of the envelope. This arrangement enables the positioning apparatus to pass through the manhole and enables the rod to swing in the boiler.

The transporting apparatus also cmprises a pole 91 which is mounted to pivot relative to the guide-rod 61, the axis of pivot being the pivot axis 81 of the rod.

The pole 91 is in use firmly fixed to the rod by means of the articulation about the axis 81. However the means for articulating the rod and the pole about the axis 81 comprises a detachable articulation, it being possible for assembly and detachment to be carried out easily from the outside of the generator by simply manipulating the rod and the associated pole.

The pole 91 has at least one movable locating pin 92 which can be manuvered by means of a cable 93 to engage in a tube 511. When the pin 92 is engaged in the tube 511, the pole 91 is immobilised and defines a reference position. The pin 92 can be collapsed in order to disengage the pole. The pole and the rod can be fixed to one another by means of a bolt 95.

Figure 4:
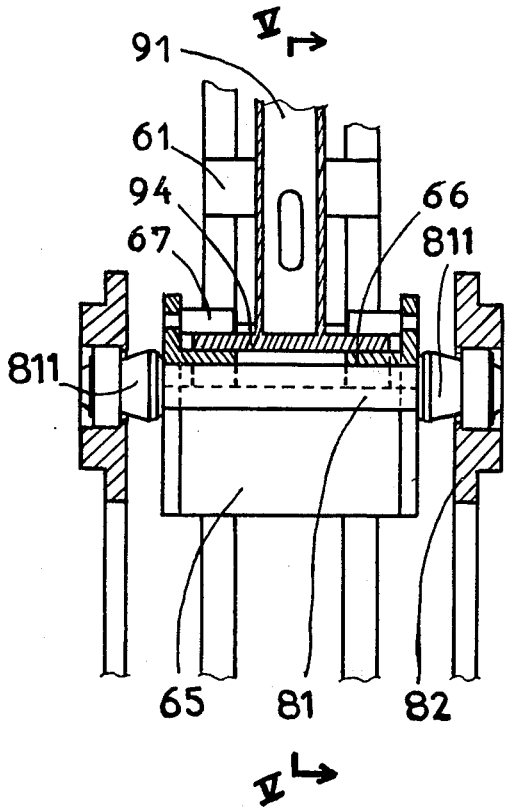
FIG. 4 is a detailed sectional view of the articulation of the transporting apparatus on the steam generator.
Figure 5:
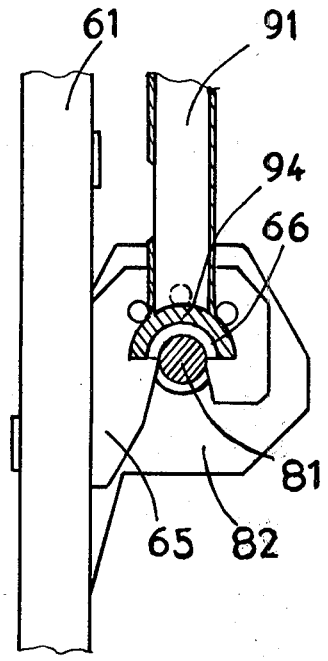
FIG. 5 is a view on the line V—V of FIG. 4.

The articulation of the rod 61 and pole 91 is shown in FIGS. 4 and 5 and enables the rod 61 and the pole 91 to pivot about the shaft 81 and permits relative pivoting of the rod and the pole about the shaft axle, it being possible for the rod and pole assembly to be disengaged from the shaft 81 by a simple movement. The rod 61 is firmly fixed to a clamp 65 which forms a semi-cylindrical bearing 66, the internal surface of which rests against the shaft 81. The pole 91 is firmly fixed to a semi-cylindrical bearing 94, the internal surface of which is in contact with the external surface of the bearing 66. The rod and the pole are connected, during rotation about the shaft 81, by means of members 67 which bear and rub against the external surface of the bearing 94. The components forming the articulation are all located on the same side of a plane passing through the axis of the shaft 81. The pole and the rod are centered on the shaft 81 by means of shoulders 811. The shaft 81 is guided in the support 82 by bearing blocks.

Stays 83 are used to immobilise the rod in various positions.

When the steam generator has stopped, and as soon as it is possible to reach the water chamber, the support 82 is fixed to the flange 55 of the manhole 53.

The transport apparatus formed by the rod 61 and its carriage 7 and the pole 91 is attached to the shaft 81. The assembly is rotated about the shaft 81 so that the pole takes up a reference position parallel to the axis of the steam generator.

The locating means 92 are operated to hold the pole in this position.

Figures 6, 7, 8:
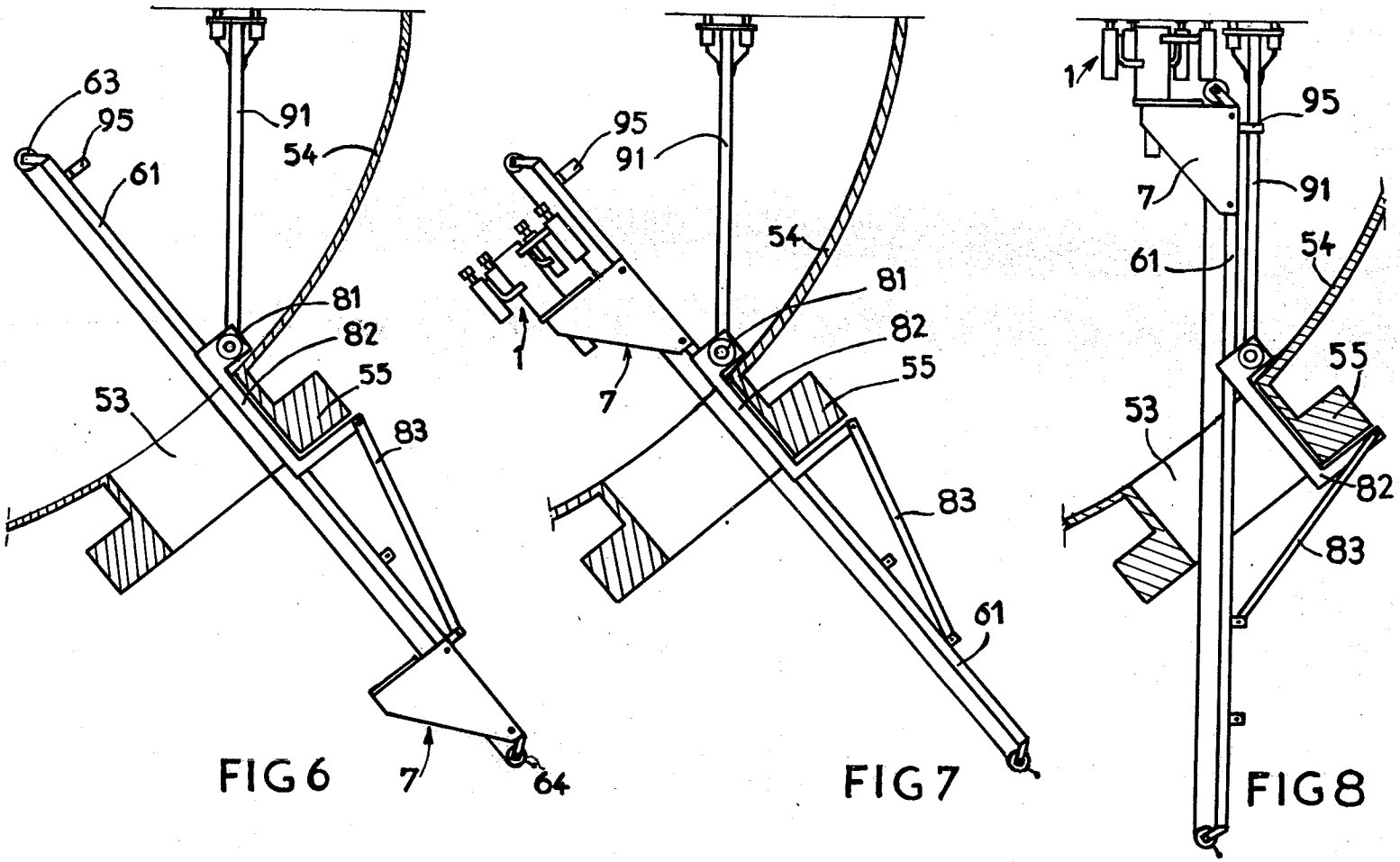
FIG. 6 illustrates a transporting apparatus fixed on an access opening of the generator, ready to receive the removable positioning apparatus.
FIG. 7 illustrates that phase where the movable unit is brought into the interior of the generator.
FIG. 8 illustrates the mobile unit in place on the tube-plate.

The bolt 95 is then operated to disconnect the rod 61 from the pole 91. The rod 61 is rotated to a position parallel to the axis of the manhole, as shown in FIG. 6. The carriage 7 is maintained in the low position (shown in FIG. 6) during these operations. Finally, the positioning apparatus is mounted on the carriage.

The carriage is then moved along the rod, to bring the carriage close to the upper end of the rod, inside the generator (FIG. 7).

The rod 61 is then rotated about the shaft 81 to a position parallel to the pole 91, and is locked to the pole 91 by operation of the bolt 95.

The carriage 7 is then moved forward towards the tube-plate 51 of the generator. The jacks 45 of the expansible mandrels are actuated in this operation. The mandrels are each positioned opposite a tube and are then inserted into a tube in the nest. Supply to the jacks is then cut off and the apparatus 1 is locked on the plate by means of its four mandrels. The carriage 7 can then be brought back to the outside of the generator by moving it along the rod 61.

Movement of the positioning apparatus 1 on the tube-plate is achieved in the following manner. By supplying, for example, the two jacks 45 at the ends of the arm 22, the corresponding two mandrels are unlocked and it is then possible, by means of the jack 38, to move the slide-block 33 away from the plate in order to extract the mandrels of the arm 22 from the tubes in which they were inserted. In this operation, the clamp 3 continues to be held on the tube plate by means of the mandrels of the arm 21 which remain connected to the tubes. When the two mandrels of the arm 22 are extracted from the tube, the jack 24 is operated to move the arm 22, by a translational movement through the slide-block 33 by a distance which is equal to the spacing between adjacent tubes of the nest. By operating the jack 38, the mandrels of the arm 22 are then reinserted into two new tubes in the nest, and by releasing the pressure in the jacks 45 the mandrels of arm 22 are locked to the new tubes.

It is then possible to perform an analogous manoeuvre, this time by unlocking the arm 21, by then moving it away from the plate, and by causing it to advance by one spacing, the apparatus this time being held to the tube plate by the arm 22 which is connected to the tubes. By using suitably chosen sequences for manoeuvring the jacks 45 or 38, after disconnecting and disengaging one or other of the arms 21 or 22, it is thus possible to move the carriage across the tube plate each time by one spacing in one direction or in the perpendicular direction. Each time that one or other of the arms moves by one spacing, there is a change in the state of the end-of-stroke contacts, with the result that, by counting the forwards and backwards impulses received by these contacts, it is possible to determine the position of the carriage on the plate relative to two rectangular coordinates. When the apparatus 1 is located at the origin of the coordinates, the forwards/-backwards counters for indicating the position are set to zero to start a sweep cycle. In accordance with the desired aim, the movement of the carriage can be programmed by automatic sequences for operating the jacks, with, of course, safety control devices so that the command for one arm to move can only be given if the other arm has finished its complete cycle. The sequences of the operations for moving the carriage automatically, and the control devices which are required to carry out these operations successfully, will not be described in detail because they can very easily be accomplished by a technician who is a specialist in automatic devices.

By means of these automatic movements of the carriage, it is possible both to ensure a systematic sweep of the whole surface of the tube-plate in question and to move the carriage towards a specific tube which it is desired to check, the position of the tube being defined by two rectangular coordinates.

At the end of the operation, the apparatus 1 is brought back to adjacent the pole 91, and the carriage 7 is then moved towards the tube-plate to couple itself to the apparatus 1 by means of the fingers 72. To enable the carriage to be moved away from the tube-plate with the apparatus 1, it suffices to cause disconnection of all the expansible mandrels of the apparatus 1. The rod 61 is then rotated about axis 81 in order to facilitate the passage of the carriage and of the apparatus 1 through the manhole.

Of course, the invention is not strictly limited to the embodiment which has been described by way of example, but it also covers those embodiments which would only differ therefrom in details, in different methods of carrying out the process or in the use of equivalent means.

What is claimed is:

1. Apparatus for use in positioning a unit successively relative to a plurality of tubes of a regular array of tubes supported by a tube-plate within an envelope provided with an access opening, said apparatus comprising: positioning apparatus for supporting the unit comprising:

two arms, connecting means for insertion in the tubes and for connection thereto, means mounting said connection means on said arms, and means mounting said arms for movement relative to one another in three perpendicular directions of which one is perpendicular to the plane of the plate and two are parallel to the plane of the plate, the amplitudes of movements of said arms parallel to the plane of the plate being integral multiples of the spacing between the tubes; and transporting apparatus associated with said positioning apparatus comprising:

a rectilinear guide rod for passing through said access opening, a carriage, means for mounting said carriage on said rod for movement therealong, coupling means for releasably coupling said positioning apparatus to said carriage during movement thereof between the outside and the inside of the enclosure and which is disconnectable to permit movement of said positioning means across the plate, and means mounting said coupling means on said carriage.

2. Apparatus according to claim 1, including a fixable support and means detachably articulating said rod to said support.

3. Apparatus according to claim 2, comprising a pole, means mounting said pole for pivotal movement relative to said rod and said support, locating means for cooperation with at least one tube, and means mounting said locating means on said pole for positioning said pole in a reference position.

4. Apparatus according to claim 3, comprising means for locking said rod to said pole such that, in the locked position, each of said connecting means of said positioning apparatus, when coupled to said carriage, is positioned opposite a tube.

5. Apparatus according to claim 3 or claim 4, comprising means for articulating said rod and said pole on said support about the same shaft.

6. Apparatus according to claim 5, wherein said articulation means comprises a semi-cylindrical bearing fixed to said rod and bearing against said shaft which is fixed to said support, and a semi-cylindrical bearing fixed to said pole and guided, during rotation, on the outside of said bearing of said rod.

7. Apparatus according to claim 1, comprising means for moving said carriage along said rod.

* * * * *